United States Patent [19]

Killop

[11] Patent Number: 4,487,047

[45] **Date of Patent: * Dec. 11, 1984**

[54] THIN-WALL SPLINE FORMING

[75] Inventor: James T. Killop, Warren, Mich.

[73] Assignee: Anderson-Cook, Inc., Fraser, Mich.

[ * ] Notice: The portion of the term of this patent subsequent to Apr. 26, 2000 has been disclaimed.

[21] Appl. No.: 479,183

[22] Filed: Mar. 28, 1983

Related U.S. Application Data

[62] Division of Ser. No. 239,266, Mar. 2, 1981, Pat. No. 4,380,918.

[51] Int. Cl.[3] ..... B21D 9/14; B21D 17/00; B21D 53/28

[52] U.S. Cl. ..... 72/88; 72/469; 29/159.2

[58] Field of Search ..... 72/88, 90, 105, 106, 72/469; 74/422, 460, 462; 29/159.2

[56] References Cited

U.S. PATENT DOCUMENTS

| | | | |
|---|---|---|---|
| 42,605 | 5/1864 | Skaats, Jr. | 74/462 |
| 1,973,185 | 9/1934 | Trbojevich | 74/462 |
| 2,760,381 | 8/1956 | Pickles | 74/460 |
| 3,040,717 | 6/1962 | Rumsey | 74/422 |
| 3,064,491 | 11/1962 | Bishop | 74/422 |
| 3,267,763 | 8/1966 | Merritt | 74/422 |
| 3,982,415 | 9/1976 | Killop | 72/469 |
| 4,028,922 | 6/1977 | Killop | 72/88 |
| 4,155,237 | 5/1979 | Jungesjo | 72/88 |
| 4,380,918 | 4/1983 | Killop | 72/88 |

OTHER PUBLICATIONS

Dudley, D. W., *Gear Handbook, The Design, Manufacture, and Application of Gears*, McGraw-Hill, New York, 1962, pp. 4–12, 4–13.

Faires, Virgil M., *Design of Machine Elements*, Macmillan Company, New York, Fourth Edition, 1964, pp. 288, 289.

*Primary Examiner*—Daniel C. Crane

*Attorney, Agent, or Firm*—Reising, Ethington, Barnard, Perry & Milton

[57] ABSTRACT

Thin-wall spline forming apparatus (20) disclosed includes toothed forming racks (24) having associated tooth pitch lines (48) and a toothed mandrel (22) having a tooth pitch circle (50) that is tangent to the forming rack pitch lines and of a diameter equal to the mean diameter of thin-wall splines (44) formed by meshing the rack and mandrel teeth with a thin-wall sleeve (38) of a power transmission member mounted on the mandrel between the meshing teeth. A mandrel drive gear (60) drives the mandrel in coordination with the forming racks (24) and is driven by a pair of drive racks (62) mounted for movement with the forming racks. Best results are achieved when the mandrel (22) has the same number of teeth (40) as the number of teeth (64) of the drive gear (60) and with the mandrel and drive gear teeth aligned with each other.

1 Claim, 6 Drawing Figures

THIN-WALL SPLINE FORMING

This application is a division of application Ser. No. 239,266, filed 3/2/81, now U.S. Pat. No. 4,380,918.

TECHNICAL FIELD

This invention relates to apparatus for splining thin-wall sleeves of power transmission members by a pair of toothed forming racks and an associated toothed mandrel.

BACKGROUND ART

U.S. Pat. No. 3,982,415, which is assigned to the assignee of the present invention, discloses a machine having apparatus for splining an annular thin-wall sleeve of a power transmission member by meshing die and mandrel teeth with the sleeve located therebetween so as to form splines in the sleeve. This spline forming process takes place in a rolling manner as the mandrel on which the power transmission member is mounted rotates upon movement of a pair of toothed dies in opposite directions on opposite sides of the mandrel. An end wall of the power transmission member is clamped against an end of the mandrel during the spline rolling process so as to insure precise forming of the splines. Clutch hubs for automatic transmissions of road vehicles is one usage for which this spline forming process has particular utility in replacing prior impacting operations used to form clutch hub splines.

U.S. Pat. No. 4,028,922, which is also assigned to the assignee of the present invention, discloses apparatus having toothed dies with different groups of teeth that cooperate with a toothed mandrel to form splines in a thin-wall sleeve of a power transmission member by the rolling process discussed above. Each toothed die includes a first tooth group of farther spaced teeth that form a first set of splines in the thin-wall sleeve in cooperation with the mandrel, and a second group of closer spaced teeth of each die thereafter cooperates with the mandrel to form a second set of splines between the first set of splines while meshing with the first set. Finally, the splined sleeve is again meshed with farther spaced teeth to provide correction of any out-of-roundness.

U.S. Pat. No. 4,155,237, which is likewise assigned to the assignee of the present invention, discloses an automatic loader for a machine that splines thin-wall sleeves of power transmission members by the rolling process discussed above.

DISCLOSURE OF INVENTION

An object of the present invention is to provide improved apparatus for forming splines in a thin-wall sleeve of a power transmission member, the apparatus being of the type including a toothed mandrel on which the sleeve is mounted in preparation for splining and also including a pair of toothed forming racks that are driven in opposite directions on opposite sides of the mandrel such that meshing of the forming racks and the mandrel with the sleeve therebetween forms splines in the sleeve.

In carrying out the above object, the forming racks have associated tooth pitch lines and the mandrel has a tooth pitch circle that is tangent to the forming rack pitch lines and of a diameter equal to the mean diameter of the formed splines. One half of the formed splines are located radially inward of the mandrel pitch circle and the other one half of the formed splines are located radially outward of the mandrel pitch circle. Good results are achieved in rolling thin-wall splines with a toothed mandrel and toothed forming racks having this construction.

A mandrel drive gear is preferably mounted for rotation with the mandrel and has teeth with a tooth pitch circle of the same diameter as and in a concentric relationship with the tooth pitch circle of the mandrel. A pair of mandrel drive racks are respectively driven with the pair of forming racks and include teeth that mesh with the mandrel drive gear and have tooth pitch lines tangent with the pitch circle of the mandrel drive gear and parallel with the pitch lines of the forming racks. Best results are achieved with the mandrel and the mandrel drive gear having the same number of teeth as each other and with the mandrel and drive gear teeth aligned with each other.

The preferred type of machine in which the spline forming apparatus is incorporated includes lower and upper bases and a rear connecting portion extending therebetween and cooperating therewith to define a forwardly opening workspace within which the toothed mandrel and the pair of toothed forming racks are located. The mandrel drive gear is also located within the workspace mounted for rotation with the mandrel and located to the rear of the mandrel. Slides respectively movable along slideways on the lower and upper bases of the machine each mount one of the forming racks and one of the mandrel drive racks such that the drive racks are driven with the forming racks so as to insure mandrel rotation in coordination with the forming racks.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
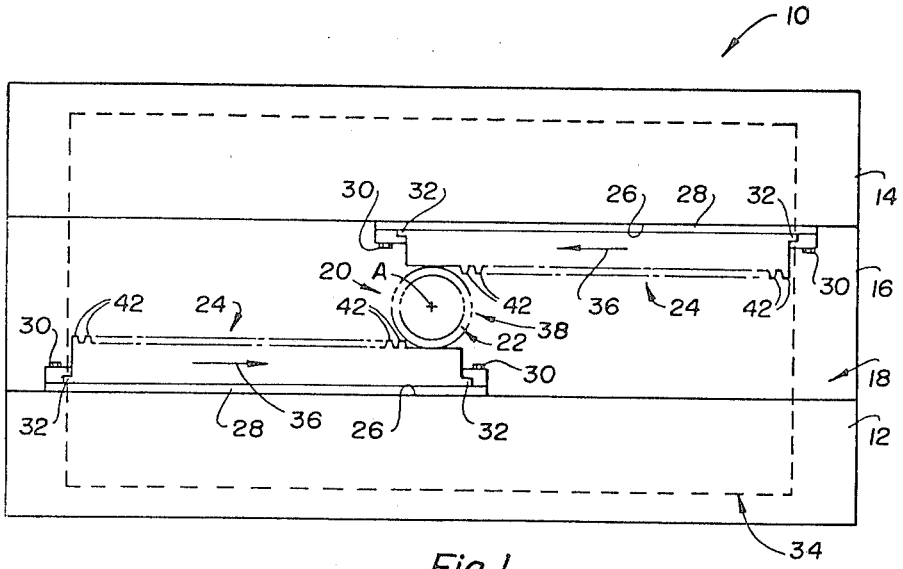
FIG. 1 is a front elevation view of a machine including a toothed mandrel and toothed forming racks for cooperatively forming splines in a thin-wall sleeve of a power transmission member in accordance with the invention.

Referring to FIG. 1 of the drawings, a spline forming machine indicated generally by 10 includes lower and upper bases 12 and 14 that are interconnected by a vertically extending rear connecting portion 16 and which project forwardly therefrom so as to define a workspace 18 that opens to the front side of the machine. Within the workspace 18, thin-wall splining apparatus constructed in accordance with the present invention is indicated collectively by reference numeral 20 and includes a schematically indicated toothed mandrel 22 rotatable about an axis A as well as a pair of lower and upper toothed forming racks 24 respectively associated with the lower and upper bases 12 and 14. Upwardly and downwardly facing slideways 26 on the lower and upper bases 12 and 14, respectively, support associated slides 28 on which the racks 24 are secured by bolted clamps 30 that engage end flanges 32 of the racks. A schematically indicated drive mechanism 34, such as of the type disclosed by the U.S. Pat. No. 3,793,866, of Anderson moves the slides 28 and the racks 24 mounted thereon rectilinearly in the direction of arrows 36 from the end-to-end relationship shown into an overlapping relationship and then reciprocally drives the racks back to the end-to-end position. During such driving, a thin-wall sleeve 38 of a power transmission member is splined by meshing of rack and mandrel teeth with the sleeve between the meshing teeth.

Figure 2:
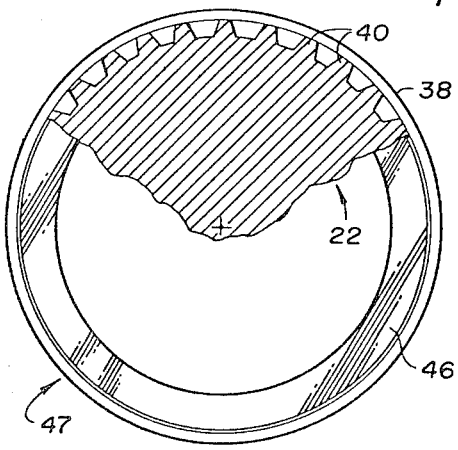
FIG. 2 is a partially sectioned view illustrating the power transmission member to be splined and the toothed mandrel on which the power transmission member is mounted during the splining.
Figure 3:
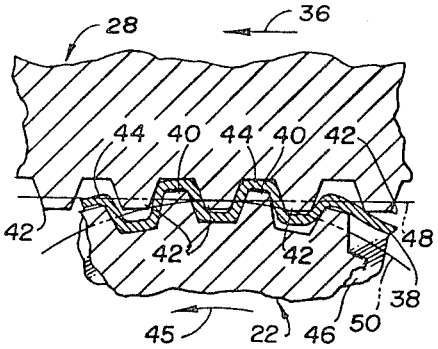
FIG. 3 is a sectional view through one of the toothed racks and the toothed mandrel as well as through the thin-wall sleeve and illustrates the manner in which the splines are formed in the sleeve by meshing of the rack and mandrel teeth with the sleeve between the meshing teeth.

As seen by additional reference to FIGS. 2 and 3, the mandrel 22 includes teeth 40 whose tips support the inner surface of the thin-wall sleeve 38 mounted thereon in preparation for the spline rolling process. Each forming rack 24 includes teeth 42 positioned along its length in an oppositely facing direction from the associated slide 28 for meshing with the mandrel teeth 40 with the thin-wall sleeve 38 located between the meshing teeth. Such meshing of the mandrel teeth 40 and the rack teeth 42 deforms the sleeve 38 at diametrically opposite upper and lower positions to form splines or teeth 44 in a rolling manner as the mandrel 22 rotates as shown by arrow 45 in FIG. 3 in coordination with the movement of each rack 24 in the direction of arrow 36. An end wall 46 of the power transmission member 47 is shown in FIG. 2 and is located at one axial end of the sleeve 38. Clamping of end wall 46 against an end of the mandrel 22 securely locates the sleeve 38 on the mandrel as the splines 44 are formed by the meshing rack and mandrel teeth.

Figure 4:
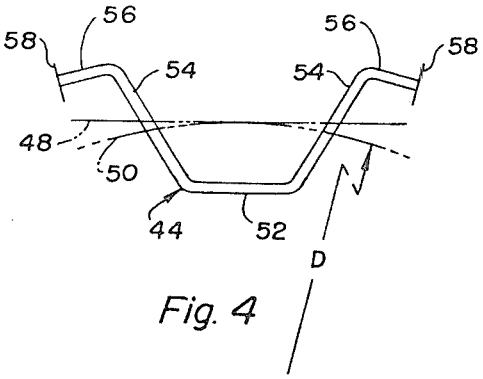
FIG. 4 is an enlarged view illustrating one of the formed splines in relationship to a tooth pitch circle of the mandrel and a tooth pitch line of one of the racks.

As illustrated in FIG. 3, each forming rack 24 has an associated tooth pitch line 48 and the mandrel 22 has a tooth pitch circle 50 that is tangent to the rack pitch lines at a radial position where the mandrel teeth 40 have the same circumferential rate of movement as the linear rate of movement of the rack teeth 42. Pitch circle 50 has a diameter D (FIG. 4) equal to the mean diameter of the formed splines 44 such that one half of each formed spline is radially inward of the mandrel pitch circle and one half of each formed spline is radially outward of the mandrel pitch circle. Splines 44 include inner lands 52 located within the mandrel pitch circle 50, side walls 54 extending from the inner lands across the mandrel pitch circle, and outer lands 56 located outwardly of the pitch circle. Circumferential midpoints of the outer lands 56 are identified in FIG. 4 by radial lines 58. The total cross-sectional area of the two halves of the outer lands 56 illustrated in FIG. 4 and the outer portions of the two side walls 54 connected thereto outside of the mandrel pitch circle 50 is thus equal to the total cross-sectional area of the inner land 52 and the portions of the two side walls 54 connected thereto inwardly of the mandrel pitch circle. Most preferably, the splines 44 are formed such that the portions thereof inward of the mandrel pitch circle 50 are congruent to the portions thereof outward of the mandrel pitch circle.

It should be mentioned that while the term "thin-wall" is defined in standard engineering terminology to mean a round wall having an inner diameter to wall thickness ratio greater than 10, this ratio is much greater for sleeves splined in accordance with the spline forming process herein disclosed. Normally, this ratio is on the order of 50 or more; for example, an internal diameter of 4 and $\frac{1}{8}$ inches and a wall thickness of about 1/16 of an inch is a ratio of 66.

Figure 5:
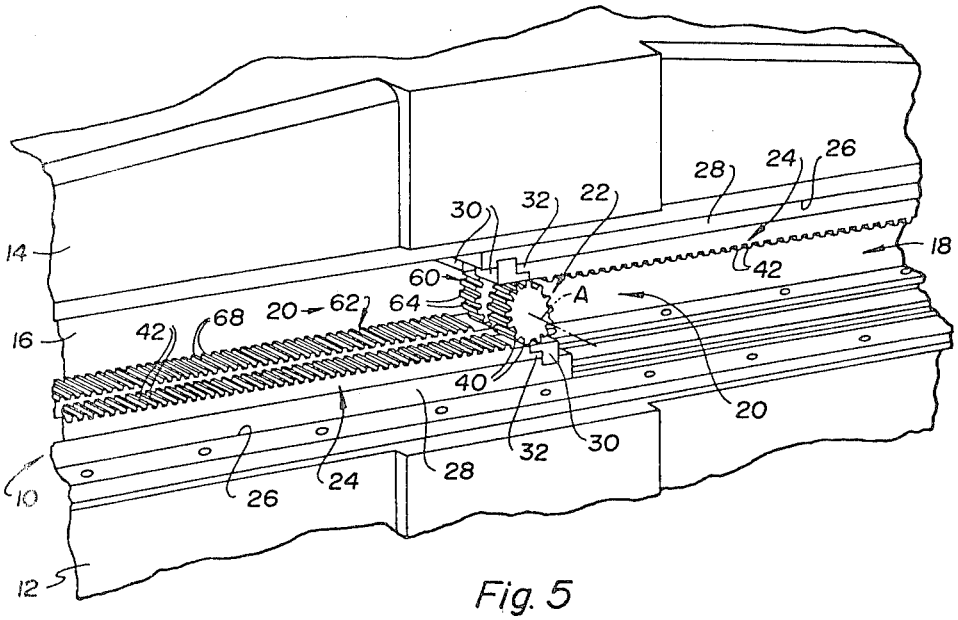
FIG. 5 is a perspective view of the spline forming machine and illustrates a mandrel drive gear and associated drive racks that mesh with the drive gear and are driven with the toothed forming racks to coordinate the mandrel rotation with the forming racks movement.
Figure 6:
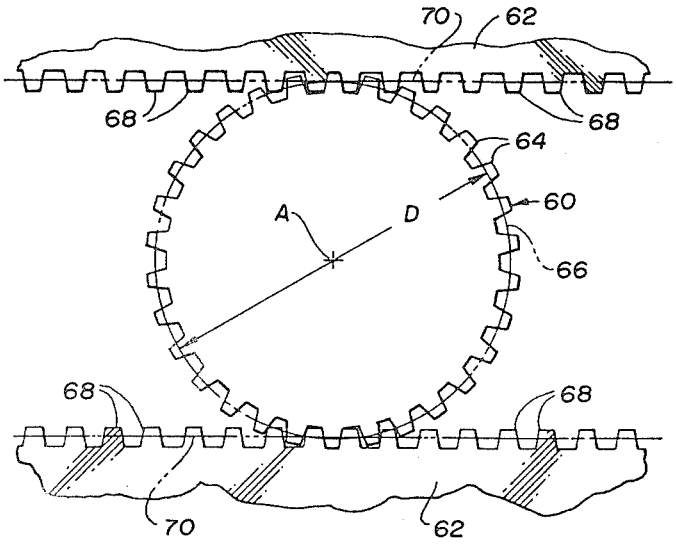
FIG. 6 is a schematic view illustrating the mandrel drive gear and the associated drive racks.

With additional reference to FIGS. 5 and 6, the splining apparatus 20 also includes a mandrel drive gear 60 mounted for rotation about the mandrel axis A and rotatively fixed to the mandrel 22 in any suitable manner at the rear thereof within the forwardly opening workspace 18. A pair of drive racks 62 are respectively mounted on the pair of slides 28 for movement with the forming racks 24 in a side-by-side relationship. Drive racks 62 mesh with the drive gear 60 such that driving rotation thereof rotates the mandrel 22 in coordination with the forming racks 24 during the spline forming operation.

As seen in FIG. 6, the mandrel drive gear 60 includes teeth 64 which have a pitch circle 66 of the same diameter D as the pitch circle of the toothed mandrel and located in a concentric relationship therewith about the axis of mandrel rotation A. Teeth 68 of the drive racks 62 mesh with the drive gear teeth 64 and have associated pitch lines 70 tangent to the pitch circle 66 thereof at a radial location where the circumferential rate of movement of the gear teeth is equal to the rectilinear rate of movement of the drive rack teeth.

Best results are achieved when the mandrel 22 illustrated in FIG. 2 has the same number of teeth 40 as the number of teeth 64 of the drive 60 illustrated in FIG. 6. The mandrel teeth are also aligned with the gear teeth such that meshing of each mandrel tooth with the associated forming rack teeth during the splining operation is accompanied by meshing of one of the gear teeth with the associated drive rack teeth.

Drive gear 60 illustrated in FIG. 6 does not have to have the same diameter at the tips of its teeth 64 as the mandrel 22 at the tips of its teeth 40. Only the tooth pitch circle 66 of the drive gear 60 must be the same as the tooth pitch circle 50 of the mandrel. As such, in many instances, the drive gear 60 can take the form of a standard gear without the necessity and consequent extra cost of being specially manufactured.

In regard to the preferred construction of the teeth of the forming racks, reference should be made to U.S. patent application Ser. No. 239,264, now U.S. Pat. No. 4,399,678 which is being filed concurrently herewith and is assigned to the assignee of the present invention.

While the best mode for carrying out the invention has been described in detail, those familiar with the art to which this invention relates will recognize other modes for practicing the invention as defined by the following claims.

What is claimed is:

1. A method for forming splines in a thin-wall sleeve of a power transmission member, said method comprising: mounting the sleeve of the power transmission member on a mandrel including teeth having a pitch circle; rotatably supporting the mandrel about a rotational axis between a pair of racks including teeth having pitch lines that are tangent to the mandrel pitch circle; and moving the racks in opposite directions as each other to mesh the rack teeth and the mandrel teeth with the sleeve therebetween to form splines that are located one-half radially inward of the mandrel pitch circle and one-half radially outward of the mandrel pitch circle.

* * * * *